US007871280B2

(12) United States Patent
Henriott

(10) Patent No.: US 7,871,280 B2
(45) Date of Patent: Jan. 18, 2011

(54) ELECTRICAL SYSTEM FOR OFFICE FURNITURE

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 102 days.

(21) Appl. No.: 12/184,338

(22) Filed: Aug. 1, 2008

(65) Prior Publication Data

US 2009/0042428 A1 Feb. 12, 2009

Related U.S. Application Data

(60) Provisional application No. 60/954,582, filed on Aug. 8, 2007.

(51) Int. Cl.
*H01R 4/60* (2006.01)

(52) U.S. Cl. ..... 439/215; 108/50.02

(58) Field of Classification Search ..... 439/215, 439/652; 108/50.01, 50.02; 312/223.3, 223.6; 174/500

See application file for complete search history.

(56) References Cited

U.S. PATENT DOCUMENTS

| | | | | |
|---|---|---|---|---|
| 3,635,174 | A | 1/1972 | Ball et al. | |
| 4,313,646 | A | 2/1982 | Millhimes et al. | |
| 5,272,277 | A | 12/1993 | Humbles et al. | |
| 5,318,454 | A | 6/1994 | Deer et al. | |
| 5,606,919 | A | 3/1997 | Fox et al. | |
| 5,886,295 | A * | 3/1999 | Carino et al. | 174/481 |
| 5,941,720 | A * | 8/1999 | Byrne | 439/215 |
| 5,957,714 | A | 9/1999 | Johnson et al. | |
| 6,004,157 | A * | 12/1999 | Glass | 439/574 |
| 6,036,533 | A | 3/2000 | Huang | |
| 6,454,597 | B1 | 9/2002 | Marsh et al. | |
| 6,540,549 | B2 | 4/2003 | Rupert | |
| 6,575,777 | B2 * | 6/2003 | Henriott et al. | 439/215 |

(Continued)

FOREIGN PATENT DOCUMENTS

| | | |
|---|---|---|
| EP | 0 179 410 | 11/2008 |

(Continued)

OTHER PUBLICATIONS

U.S. Appl. No. 12/122,099, filed May 16, 2008 entitled: Multi-Purpose Table With Electrical Features.

(Continued)

*Primary Examiner*—Hae Moon Hyeon
(74) *Attorney, Agent, or Firm*—Baker & Daniels LLP

(57) ABSTRACT

An article of furniture having a construction adapted to efficiently accommodate electrical components. The article of furniture includes a frame or chassis having support leg assemblies, and a beam connected to the support leg assemblies to which a channel is mounted. The support leg assemblies include work surface supports which support work surfaces at adjustable heights above the channel, and a gap between the work surfaces allows access to the electrical system within the channel. The electrical system is modular in design, and includes a series of components that are connected to one another in a manner that the location of electrical outlet modules is easily adjusted. The channel has a plurality of knock-out openings which are selectively used for locating electrical outlets at any desired position along the channel.

13 Claims, 14 Drawing Sheets

U.S. PATENT DOCUMENTS

| | | | | |
|---|---|---|---|---|
| 6,746,274 | B1 | 6/2004 | Verfuerth | |
| 6,974,911 | B2 | 12/2005 | Hyde | |
| 7,008,248 | B2 | 3/2006 | Kondas et al. | |
| 7,021,961 | B1 | 4/2006 | Soderholm | |
| 7,294,005 | B1 * | 11/2007 | Laukhuf | 439/215 |
| D562,586 | S | 2/2008 | Parker | |
| D569,142 | S | 5/2008 | Burak | |
| D571,586 | S | 6/2008 | Burak | |
| D573,820 | S | 7/2008 | Burak | |
| 7,614,896 | B2 * | 11/2009 | Johnson et al. | 439/215 |
| 7,651,353 | B2 * | 1/2010 | Laukhuf | 439/215 |
| 2006/0249060 | A1 | 11/2006 | Waisbrod | |
| 2006/0261712 | A1 | 11/2006 | Henriott et al. | |
| 2007/0087604 | A1 | 4/2007 | Hayes et al. | |
| 2008/0188106 | A1 * | 8/2008 | Byrne | 439/215 |
| 2008/0254661 | A1 * | 10/2008 | Byrne | 439/215 |

FOREIGN PATENT DOCUMENTS

| | | |
|---|---|---|
| WO | 2008/041869 | 4/2008 |
| WO | 2008/041872 | 4/2008 |
| WO | 2008/041873 | 4/2008 |
| WO | 2008/048113 | 4/2008 |

OTHER PUBLICATIONS

Partial International Search Report dated Nov. 13, 2008 in PCT/US2008/071907.

* cited by examiner

ELECTRICAL SYSTEM FOR OFFICE FURNITURE

CROSS-REFERENCE TO RELATED APPLICATIONS

This application claims the benefit under Title 35, U.S.C. §119(e) of U.S. Provisional Patent Application Ser. No. 60/954,582, entitled ELECTRICAL SYSTEM FOR OFFICE FURNITURE, filed on Aug. 8, 2007, the disclosure of which is expressly incorporated by reference herein in its entirety.

BACKGROUND

1. Field of the Invention

The present invention relates to the management of electrical and/or communication cables associated with an article of furniture, such as, for example, an article of office furniture.

2. Description of the Related Art

Articles of office furniture, such as tables, are often used in environments which require electrical outlets and/or communication outlets near a work surface, such that a user may plug an electrical cord into the electrical outlet to power a device positioned on or proximate the article of furniture, or may plug a communication cable into the communication outlet to provide data service to a device positioned on or proximate the article of furniture. Some municipalities allow articles of furniture to include electrical outlets having power supplied thereto via extension cords plugged into existing outlets in a building or other structure in which the article of furniture is positioned. Other municipalities do not permit such extension cords and instead require that power supplies to the electrical outlets be fully contained and not connected via extension cords.

Referring to an exemplary article of furniture shown in FIG. 1, table 20 includes channel 26 mounted beneath its work surface. As shown in FIG. 2, a typical commercially available electrical assembly includes an electrical harness 28 that may be positioned within channel 26 beneath the work surface of table 20. Electrical systems including electrical harness 28 are commercially available from many commercial sources, such as Dekko Engineering, a Group Dekko Company, of Kendallville, Ind.; Byrne Electrical Specialists of Rockford, Mich.; and Union Electric. Electrical harness 28 is connected to a power supply via power supply cable 22. Electrical harness 28 may include connectors 23 on each end of buss bar 27. Electrical outlet modules 29 are connected directly to connectors 23 of buss bar 27 and are thereby positioned in fixed locations relative to connectors 23 and buss bar 27. Electrical jumper cable 24 may engage connector 23 on one end of buss bar 27 and connect electrical harness 28 to electrical components associated with an adjacent table (not shown).

Thus, each electrical outlet module 29 is fixedly attached to buss bar 27 such that outlet module 29 cannot move or be re-positioned relative to channel 26. Openings 25 are provided in sidewalls 21 of channel 26 to provide access to electrical outlet modules 29. Buss bar 27 defines a fixed length L, shown in FIG. 2, which cannot be varied, thereby forcing outlet modules 29 at each end of buss bar 27 to be positioned at a fixed distance from one another dependent on length L. Openings 25 in channel 26 must be positioned in registry with outlet modules 29, and, thus, must be spaced a distance approximately equal to length L such that a user may access outlet modules 29.

Thus, a manufacturer of an article of furniture such as table 20, including channel 26, must design channel 26 in view of length L of buss bar 27. The fixed length of buss bar 27 forces the manufacturer to inventory a plurality of buss bars 27 of varying lengths, as well as a plurality of channels 26 having openings 25 of varying configurations, in order to manufacture tables 20 and/or other articles of furniture of varying size and/or having outlet modules 29 positioned at varying locations.

What is needed is an article of furniture with an electrical system that is an improvement over the foregoing.

BRIEF SUMMARY

The present invention provides an article of furniture having a construction adapted to efficiently accommodate electrical components. The article of furniture includes a frame or chassis having support leg assemblies, and a beam connected to the support leg assemblies to which a channel is mounted. The support leg assemblies include work surface supports which support work surfaces at adjustable heights above the channel, and a gap between the work surfaces allows access to the electrical system within the channel. The electrical system is modular in design, and includes a series of components that may be connected to one another in a manner that the location of electrical outlet modules may be easily adjusted. The channel has a plurality of knock-out openings which may be selectively used for locating electrical outlets at any desired position along the channel.

Advantageously, the present invention eliminates the need for using a known electrical harnesses assembly of the type described above and shown in FIGS. 1 and 2, in favor of a relatively wider channel that may incorporate a modular electrical system including components that may be selectively configured to place electrical and/or data outlets in locations desired by the user. The relatively wider channel allows electrical and/or data outlets to be placed beneath the work surface of the table at locations nearer the user, allowing easier access, and also facilitates easy installation of the electrical assembly, which may be laid into the channel freely with only the electrical and/or data outlets connected to the knock-out openings in the channel.

A method for forming the knock-out openings in the channel is also disclosed, in which the knock-out portions are first stamped in a flat metal sheet that will eventually be formed into the channel. In particular, the knock-out portions are partially separated from the sheet and displaced from the plane of the sheet using a punch and die. In the subsequent forming process by which the channel is formed form the sheet, the knock-out portions are pressed substantially back into the plane of the sheet itself by a bending die, with the result that the knock-out portions may be easily separated from the knock out openings while the periphery of the knock-out portions is visually disguised, such that even though the channel is formed with knock-out openings, the surface of the channel visually appears substantially smooth and uninterrupted.

In one form thereof, the present invention provides an article of furniture, including at least a pair of leg assemblies; a horizontally-disposed beam connecting the leg assemblies; a horizontally-disposed channel mounted to the beam, the channel including side walls with at least one of the side walls having a plurality of openings; a plurality of work surface supports connected to the leg assemblies, the work surface supports supporting at least a pair of work surfaces above the leg assemblies at locations disposed vertically upwardly from the channel; and an electrical system disposed within the channel, the electrical system including a power supply assembly including at least one first connector at one end thereof, the power supply assembly connected to a source of electrical power at an opposite end thereof; an electrical connector assembly including a plurality of second connectors, including at least one second connector at one end of the connector assembly and at least one second connector at an opposite end of the connector assembly, one of the second connectors connected to the first connector; at least one electrical outlet module assembly having an outlet module with an electrical outlet, and a flexible cable having a third connector at an end thereof spaced from the outlet module, the third connector connected to at least one of the first and second connectors, and the outlet module connected within one of the channel openings with the electrical outlet accessible from externally of the channel.

In another form thereof, the present invention provides an article of furniture, including at least a pair of leg assemblies; a horizontally-disposed beam connecting the leg assemblies; a horizontally-disposed channel mounted to the beam; a plurality of work surface supports connected to the leg assemblies, the work surface supports supporting at least a pair of work surfaces above the leg assemblies at locations disposed vertically upwardly from the channel; and an electrical system disposed within the channel, the electrical system including a power supply assembly including at least one first connector at one end thereof, the power supply assembly connected to a source of electrical power at an opposite end thereof; an electrical connector assembly including a plurality of second connectors, including at least one second connector at one end of the connector assembly and at least one second connector at an opposite end of the connector assembly, one of the second connectors connected to the first connector; at least one electrical outlet module assembly having an outlet module with an electrical outlet, and a flexible cable having a third connector at an end thereof spaced from the outlet module, the third connector connected to at least one of the first and second connectors, the outlet module further including a mount structure connecting the outlet module to an edge of one of the work surfaces.

In a further form thereof, the present invention provides a method of manufacturing a component of an article of office furniture, including providing a metal sheet; stamping at least one knock-out portion in the metal sheet to form a periphery around said knock-out portion with the knock-out portion displaced at least partially outwardly from a plane defined by the sheet; and engaging the sheet with at least a pair of bending members, at least two of the bending members engaging respective opposite sides of the sheet and pressing said knock-out portion substantially back within the plane of the sheet while preserving the knock-out periphery; and bending the sheet along a bend line displaced from the knock-out portion.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplary embodiments of the invention illustrated herein are not to be construed as limiting the scope of the invention in any manner.

DETAILED DESCRIPTION

Figure 3:
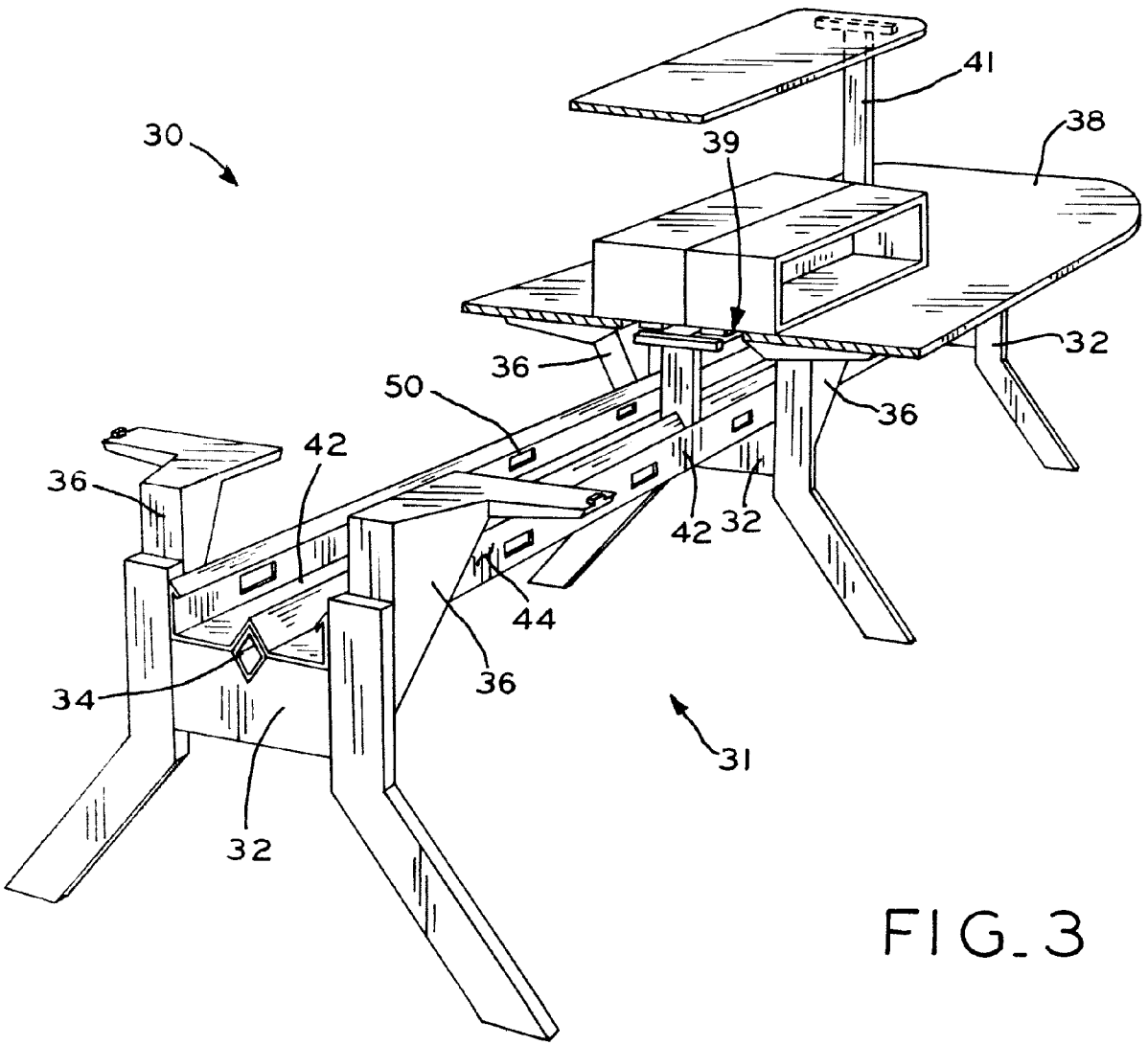
FIG. 3 is a partially sectioned perspective view of an article of furniture, shown as a desking system, with a channel and an electrical wiring configuration according to one embodiment of the present invention.

Referring to FIG. 3, an article of office furniture is shown as a desking system 30, but may also be formed as a table, a partition system, or any other article of furniture. Desking system 30 includes a support frame or chassis 31 having at least a pair of leg assemblies 32 and a horizontally-disposed beam 34 connecting leg assemblies 32. A horizontally-disposed channel 42 is mounted to beam 34, and is discussed in detail below. A plurality of work surface supports 36 are connected to leg assemblies 32, and support a plurality of work surfaces 38 above leg assemblies 32 at locations disposed vertically upwardly from channel 42. Work surfaces 38 are shown only in the upper right portion of FIG. 3 such that frame 31 is visible therebeneath, it being understood that frame 31 would normally support work surfaces 38 positioned at the lower left portion is FIG. 3 on work surface supports 36. The rear edges of work surfaces 38 may define a gap 39 therebetween which is disposed above channel 42. Work surface supports 36 are also connected to leg assemblies 32 via adjustment mechanisms (not shown) by which the height of work surfaces 38 with respect to channel 42 may be adjusted. Desking system 30 may also include an overhead frame structure 41 including horizontal and vertical frame members which support modular components such as cabinets and lighting assemblies.

Figure 4:
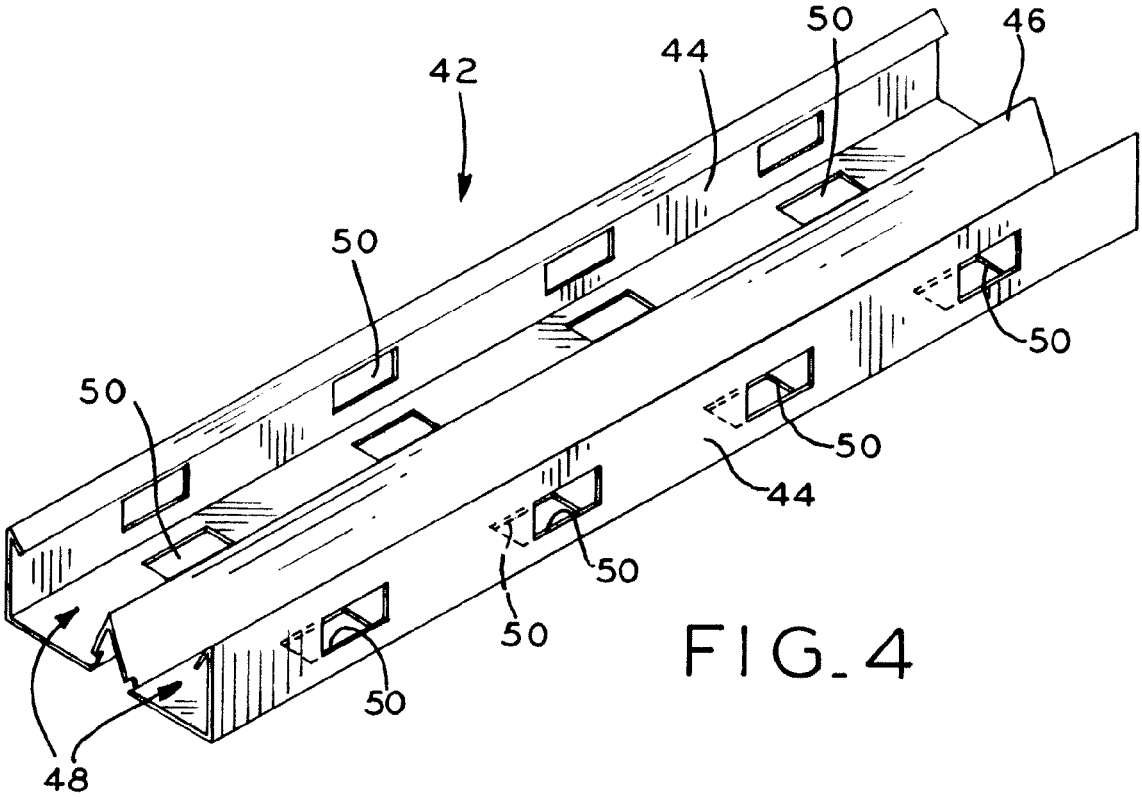
FIG. 4 is a perspective view of the channel of the desking system of FIG. 3.

As shown in FIG. 4, channel 42 includes sidewalls 44, cross bar 46, and troughs 48 for housing and maintaining snap-in electrical module 52 (FIG. 9), communication module 54 (FIG. 13), and optionally a plurality of various cords and cables associated with the modules. Each sidewall 44 may include at least one opening 50 having a knock-out portion (not shown in FIG. 4), discussed below, that may be removed to allow receipt of electrical modules 52 and/or communication modules 54 with openings 50. In one embodiment, discussed below, the knock-out portion may be a piece of material that may be punched out to allow an installer to selectively choose the locations for mounting electrical modules 52 and/or communication modules 54, as described below. Similarly, troughs 48 may also include downwardly-facing openings 50 with knock-outs that may be removed to accommodate electrical modules 52 and/or communication modules 54.

Figure 5:
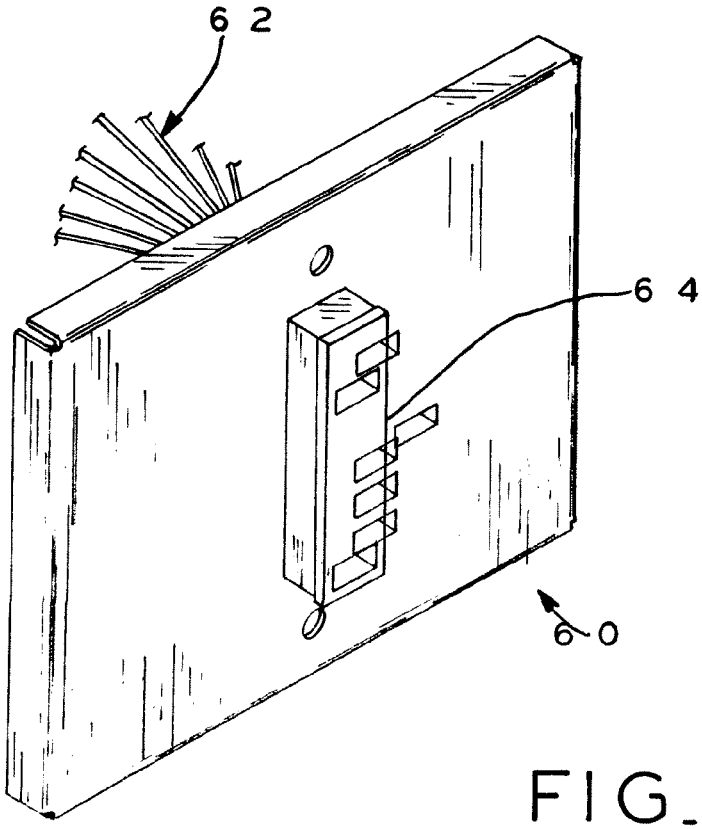
FIG. 5 is a perspective view of a modular wall assembly.

Referring now to FIG. 5, modular wall starter assembly 60 is shown and may include wires 62 for a hard-wired connection to an existing power supply in a building or other structure, and connectors 64 for providing a connection for an electrical jumper assembly or a connector assembly, as described below. In an exemplary embodiment, modular wall starter assembly 60 is an eight-wire wall starter connector.

Figure 6:
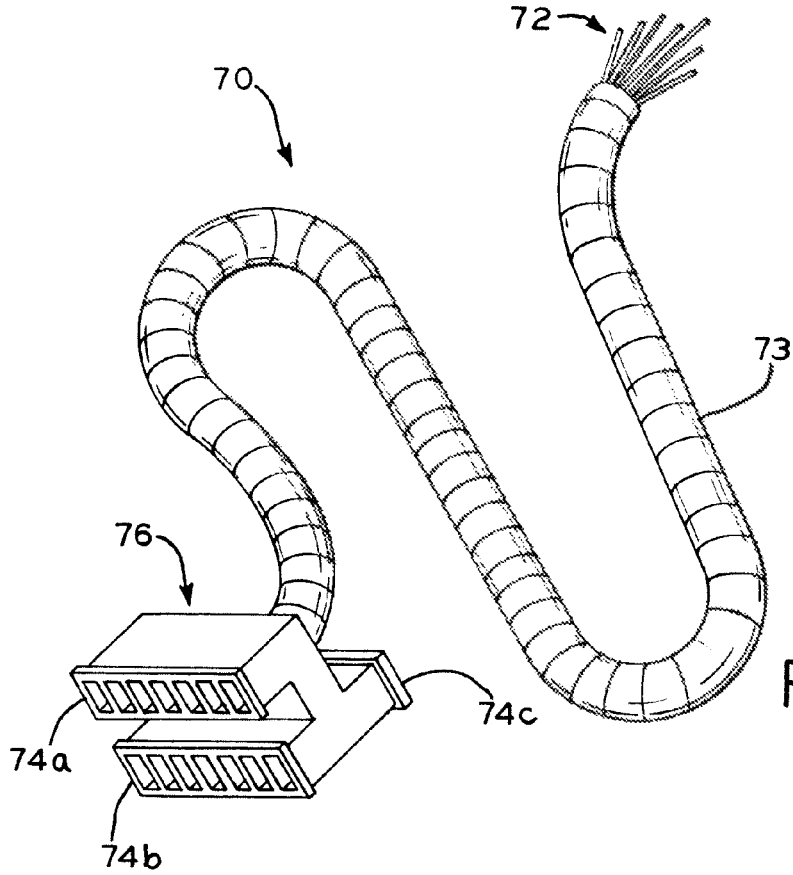
FIG. 6 is a perspective view of a power supply assembly.

Referring now to FIG. 6, power supply assembly 70 is shown and may include wires 72 for a hard-wired connection to an existing power supply in a building or other structure, and connector module 76. Connector module 76 is attached at the end of cable 73 and provides connectors 74*a*, 74*b*, 74*c* for connecting to an electrical jumper assembly or an electrical outlet module, as described below. In an exemplary embodiment, power supply cable 73 includes a flexible, liquid-tight covering, such as a polymeric shielding material, and extends approximately fifteen feet. Connectors 74*a*, 74*b*, 74*c*, as well as the other connectors disclosed herein, may be male/female type, eight-wire electrical connectors.

Figure 7:
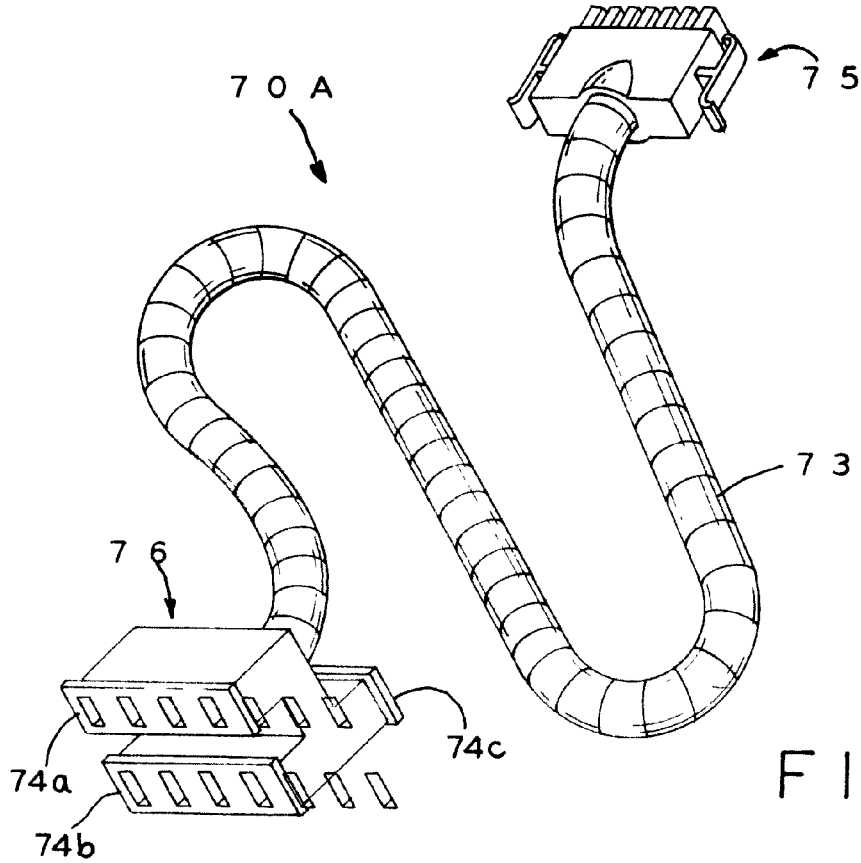
FIG. 7 is a perspective view of a connector assembly.

Referring now to FIG. 7, modular connector assembly 70A is shown and is substantially identical to power supply assembly 70, described above with reference to FIG. 6, except as described below. Modular connector assembly 70A may include electrical connector 75 for coupling to a power supply, such as connector module 76 of power supply cable assembly 70 (FIG. 6) or connectors 64 of modular wall starter assembly 60 (FIG. 5), for example.

Figure 8:
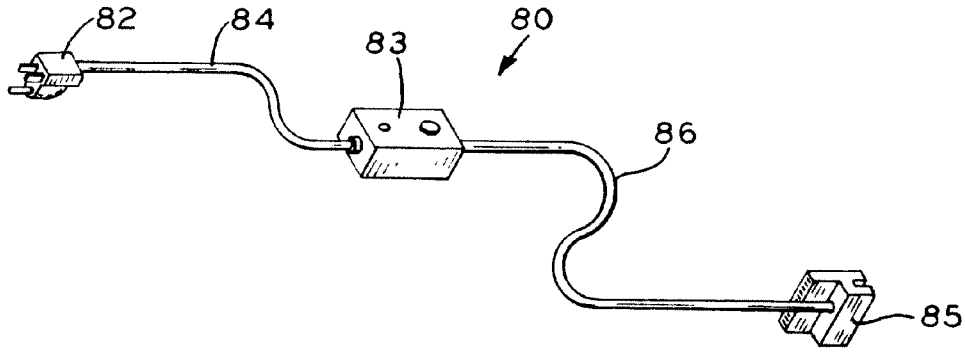
FIG. 8 is a perspective view of another power supply assembly.

Referring now to FIG. 8, power supply cable assembly 80 is shown and may include plug-in connector 82, first cable 84, second cable 86, and electrical connector 85 for coupling to a jumper assembly and/or an electrical outlet module, as described below. Power supply cable assembly 80 may include circuit box 83 disposed between first cable 84 and second cable 86. Circuit box 83 monitors the electrical load supplied to the line and provides a resistor or relay which prevents current flow to electrical connector 85 when the load exceeds a preset threshold, for example, when too many plugs are connected downstream of electrical connector 85. In an alternative embodiment, circuit box 83 is eliminated and first cable 84 is continuous with second cable 86. In one embodiment, power supply cable assembly 80 is a single circuit power supply cable assembly.

Figure 9:
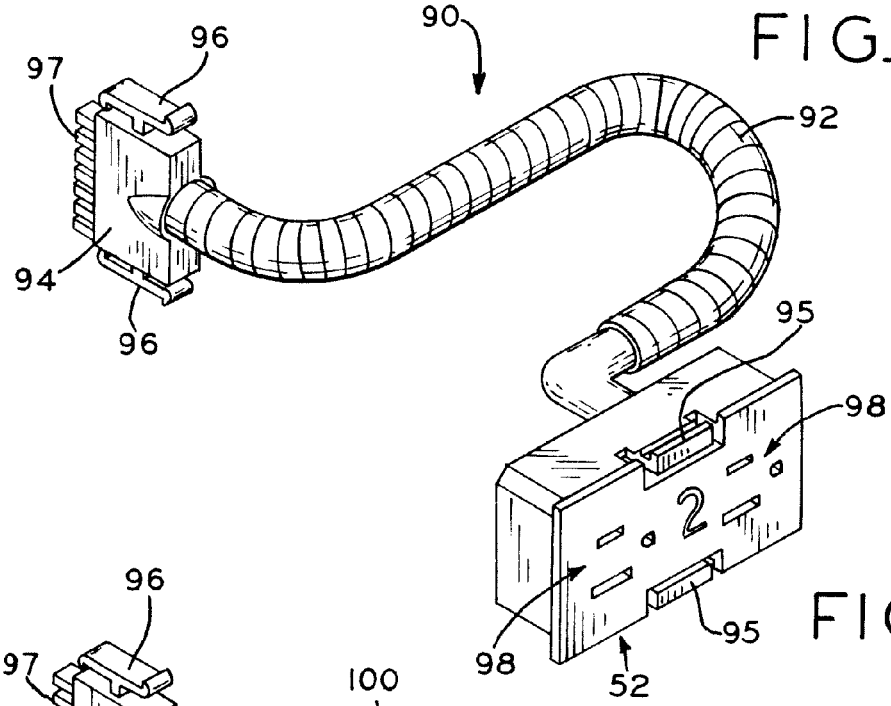
FIG. 9 is a perspective view of an electrical outlet module and its associated cable and connector.

Referring now to FIG. 9, electrical module 52 is shown and may be formed as part of electrical module assembly 90. Electrical module assembly 90 may also include a flexible, shielded cable 92 which connects electrical connector 94 and electrical module 52. Electrical module 52 may include resilient tabs, tangs or buttons 95 on sides thereof which may include barbs for providing a snap-fit engagement with openings 50 of channel 42 (FIG. 4), as described below. Electrical module 52 further may include at least one electrical outlet 98 for receipt of an electrical plug (not shown). To mount electrical module 52 within an opening 50 of channel 42, a user may remove the knock-out portion from opening 50, and then position electrical module 52 within opening 50 such that electrical outlets 98 face away from channel 42. The user may depress resilient tangs 95 and then position electrical module 52 within opening 50. The user may then release resilient tangs 95 to secure electrical module 52 in channel 42.

In another method, a user may position electrical module 52 within opening 50 such that electrical outlets 98 face away from channel 42 and then the user may force electrical module 52 within opening 50 in channel 42. Resilient tangs 95 are biased inward upon contacting the edges surrounding opening 50. Once electrical module 52 has been pushed further into opening 50 of channel 42, resilient tangs 95 are returned to an unbiased state such that electrical module 52 is securely positioned in channel 42. Once resilient tangs 95 are released, electrical module 52 is retained in channel 42. Electrical module 52 may be an eight-wire, four-circuit electrical system. In another embodiment, electrical module 52 is a single circuit system. Cable 92 may contain a plurality of electrical wires in a sealed coating. Cable 92 may be flexible such that a user can manipulate cable 92 into a desired configuration, as described below.

Electrical connector 94 may be used to electrically connect electrical module 52 to a power supply or another component. For example, electrical connector 94 may include resilient tangs 96 to facilitate coupling electrical connector 94 with a connector assembly or with a jumper assembly, as described below. Electrical connector 94 may include connector 97 for coupling with the power supply.

Electrical modules 52 may be stand-alone electrical components which do not need any jumper connections. In another embodiment, electrical modules 52 are hard-wired electrical components which are joined together via electrical wires and/or cables which provide power to electrical modules 52. In yet another embodiment, electrical modules 52 are attached via wires or extension cords to an existing outlet in a building or other structure in which table 40 is positioned to provide power to electrical modules 52.

Figures 13, 14:
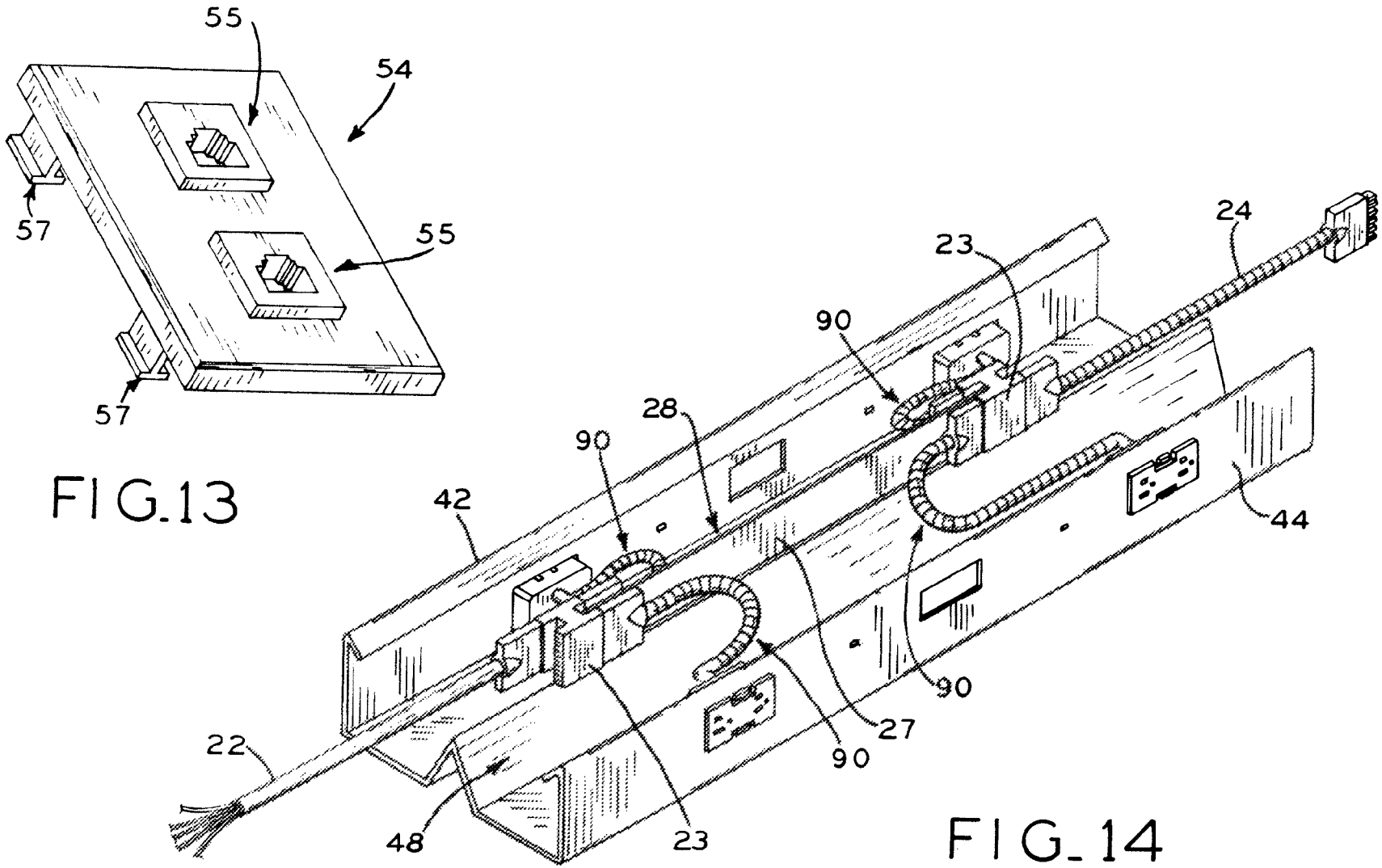
FIG. 13 is a perspective view of a communication module.
FIG. 14 is a perspective view of the channel of FIG. 3 with a wiring configuration according to a further embodiment.

As shown in FIG. 13, in addition to, or in place of, electrical modules 52, communication modules 54 may also be used in a similar manner with channel 42. Communication modules 54 may be AMP-style data ports, such as telephone, cable, internet, or Ethernet connections, and include communication outlets 55 and resilient tangs 57. Communication module 54 may be positioned in channel 42 in similar ways as described above with respect to electrical modules 52. At least one communication module 54 and at least one electrical module 52 may be positioned in the same trough 48 (FIG. 4) or may be positioned in opposite troughs 48 on each side of cross bar 46 (FIG. 4).

Figure 10:
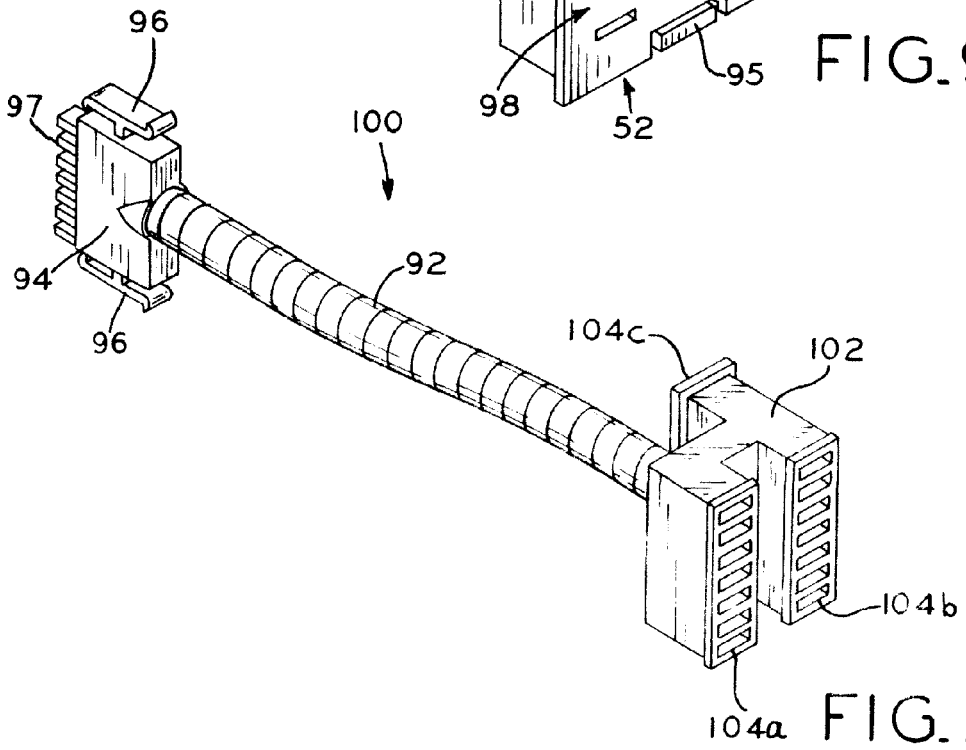
FIG. 10 is a perspective view of a jumper assembly.

Referring now to FIG. 10, electrical connector assembly 100 is shown and may include cable 92 which connects electrical connector 94 and connector module 102. Electrical connector 94 provides connector 97 for connecting to a power supply of to one of the connectors of a connector module 102 of another connector assembly 100. Connector module 102 provides connectors 104*a*, 104*b*, 104*c* for connecting to an electrical jumper assembly and/or an electrical outlet module, as described below.

Figure 11:
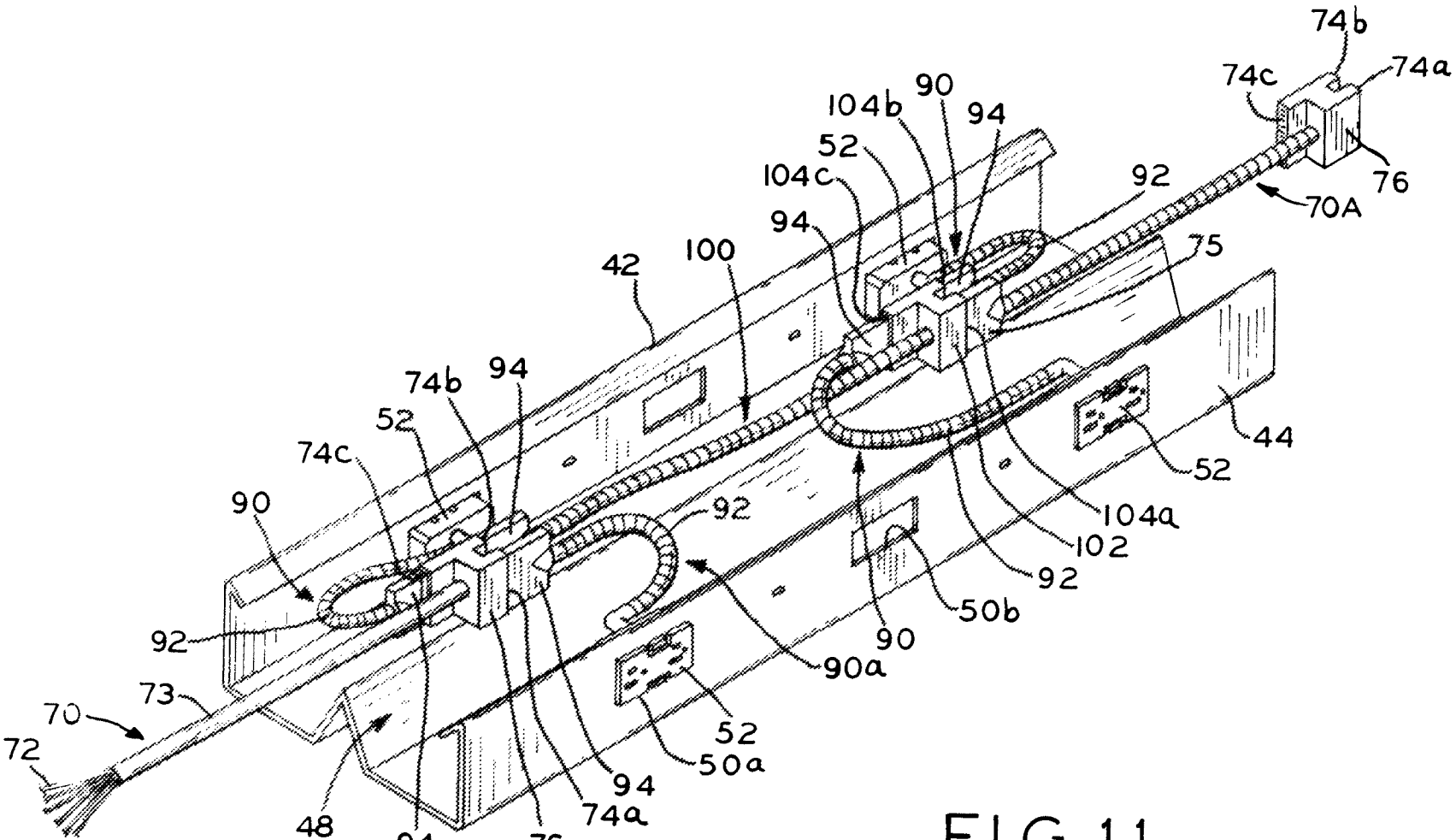
FIG. 11 is a perspective view of the channel of FIG. 3 with an exemplary wiring configuration.

Referring now to FIG. 11, an exemplary system is shown and may include several of the components described above. Power supply cable assembly 70 may have wires 72 connected to an existing power supply of a building or other structure. Alternatively, power supply cable assembly 70A may be coupled to a modular wall starter assembly 60 (FIG. 5) provided in the wall of the building or structure. Power supply cable 73 extends into trough 48 of channel 42 and has connector module 76 with connectors 74*a*, 74*b*, 74*c* positioned within trough 48. A first electrical module assembly 90 may be connected to power supply cable assembly 70 by coupling electrical connector 94 of the first electrical module assembly 90 to connector 74*c* of connector module 76. A second electrical module assembly 90 may be connected to power supply cable assembly 70 by coupling electrical connector 94 of the second electrical module assembly 90 to connector 74*a* of connector module 76. Electrical modules 52 of each electrical module assembly 90 may be positioned and secured in cutout portions 50 of channel 42 in the manner as described above.

Advantageously, cables 92 of electrical module assemblies 90 allow electrical modules 52 to be positioned in any opening 50 proximate connector module 76. For example, as may be seen in FIG. 11, electrical module assembly 90*a* may be positioned in either of openings 50*a* or 50*b* which are proximate connector module 76 to which electrical module assembly 90*a* is connected. Moreover, as discussed below, openings 50*a*, 50*b* may be formed with knock-out pieces of material in channel 42 and an installer of the system may choose which opening 50*a*, 50*b* of channel 42 to use. After punching out and removing the knock-out portion corresponding to the selected opening 50, electrical module 52 may be positioned therein, as described above. Thus, electrical modules 52 may be positioned within selected openings 50 anywhere along the length of channel 42.

Furthermore, advantageously, the flexible cable 92 allows the option to choose which opening 50 to utilize and also bridges the gap between sidewall 44 of channel 42 and connector module 76, thereby allowing electrical module 52 to be positioned at sidewall 44 and providing easy access for a user of channel 42. The length of cable 92 allows an installer to position electrical module 52 in any cutout portion 50 proximate connector module 76.

Electrical connector 94 of electrical connector assembly 100 may connect to connector 74*b* of power supply assembly 70 and cable 92 of assembly 100 extends further through trough 48. At the opposing end of cable 92 of electrical connector assembly 100, connector module 102 is provided with connectors 104*a*, 104*b*, 104*c*. In a similar manner as described above with respect to connectors 74*a*, 74*c*, two electrical module assemblies 90 are connected to connectors 104*a*, 104*c* and the associated electrical modules 52 are positioned in openings 50 of channel 42.

Modular power supply cable assembly 70A may be connected to connector 104*b* of electrical connector assembly 100, thereby providing connector module 76 extendable from channel 42 and operable to connect to electrical components positioned in an adjacent channel or other article of furniture.

Figure 12:
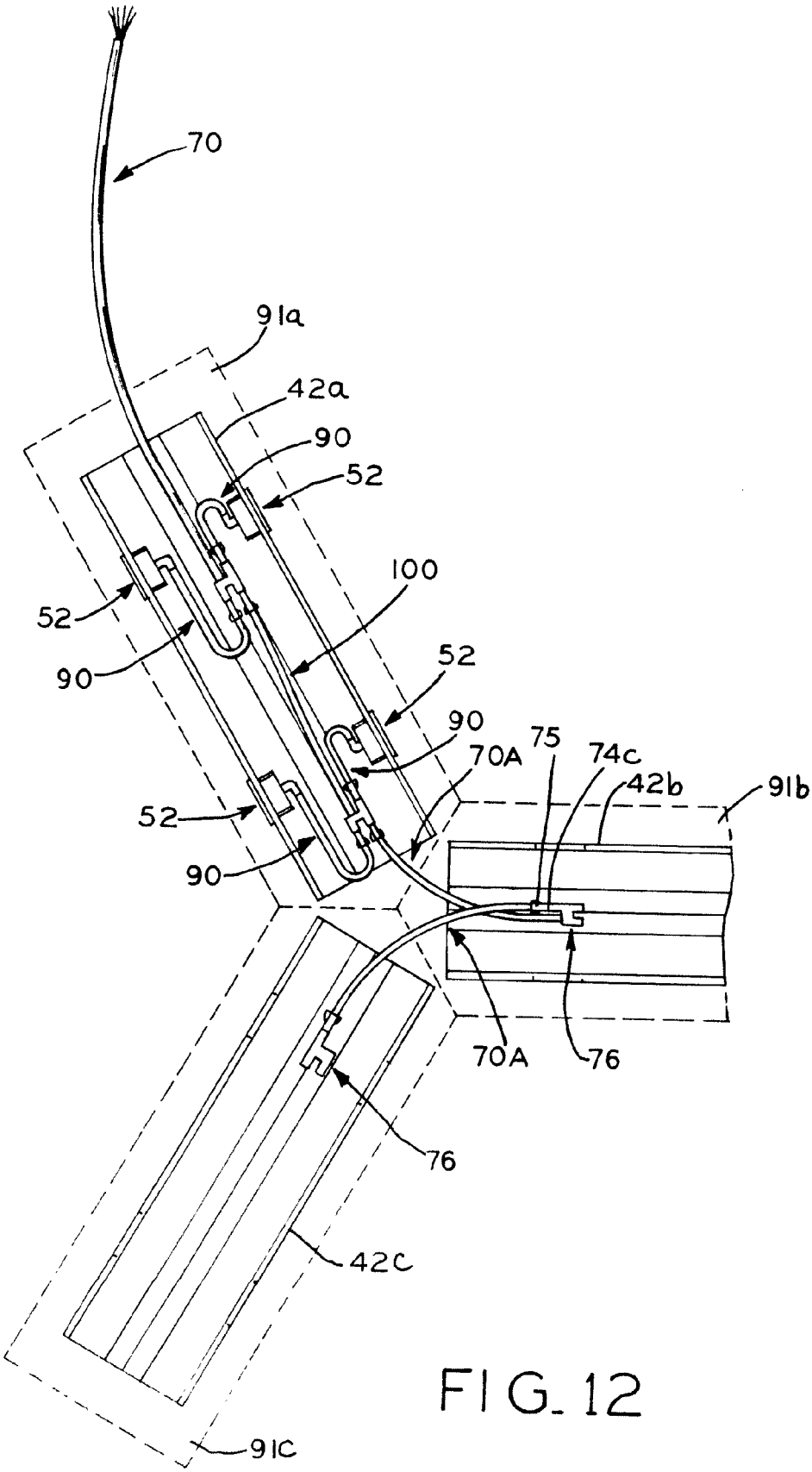
FIG. 12 is a top view of a plurality of channels with an exemplary wiring configuration.

Referring now to FIG. 12, three channels 42*a*, 42*b*, 42*c* are shown and are associated with three dashed-in articles of furniture 91*a*, 91*b*, 91*c*, respectively, which are arranged in a 120° configuration and may each be separate components of desking system 30 shown in FIG. 3 and discussed above. Channel 42*a* is identical to channel 42, as described above with reference to FIG. 11, and has the identical wiring configuration as shown in FIG. 11. Connector module 76 extends from channel 42*a* and enters channel 42*b* which may either be associated with another article of furniture 91*b* or positioned adjacent to channel 42*a* on the same article of furniture. Another modular power supply assembly 70A may be connected to connector 74*c* of connector module 76 and extend from channel 42*b* into channel 42*c*. Channel 42*c* may either be associated with another article of furniture 91*c* or positioned adjacent to at least one of channel 42*a*, 42*b* on the same article of furniture. Each channel 42 may be connected to a different article of furniture, such that the configuration shown in FIG. 12 may advantageously be utilized in a workspace configuration system and may be utilized to link several different articles of furniture.

Figure 1:
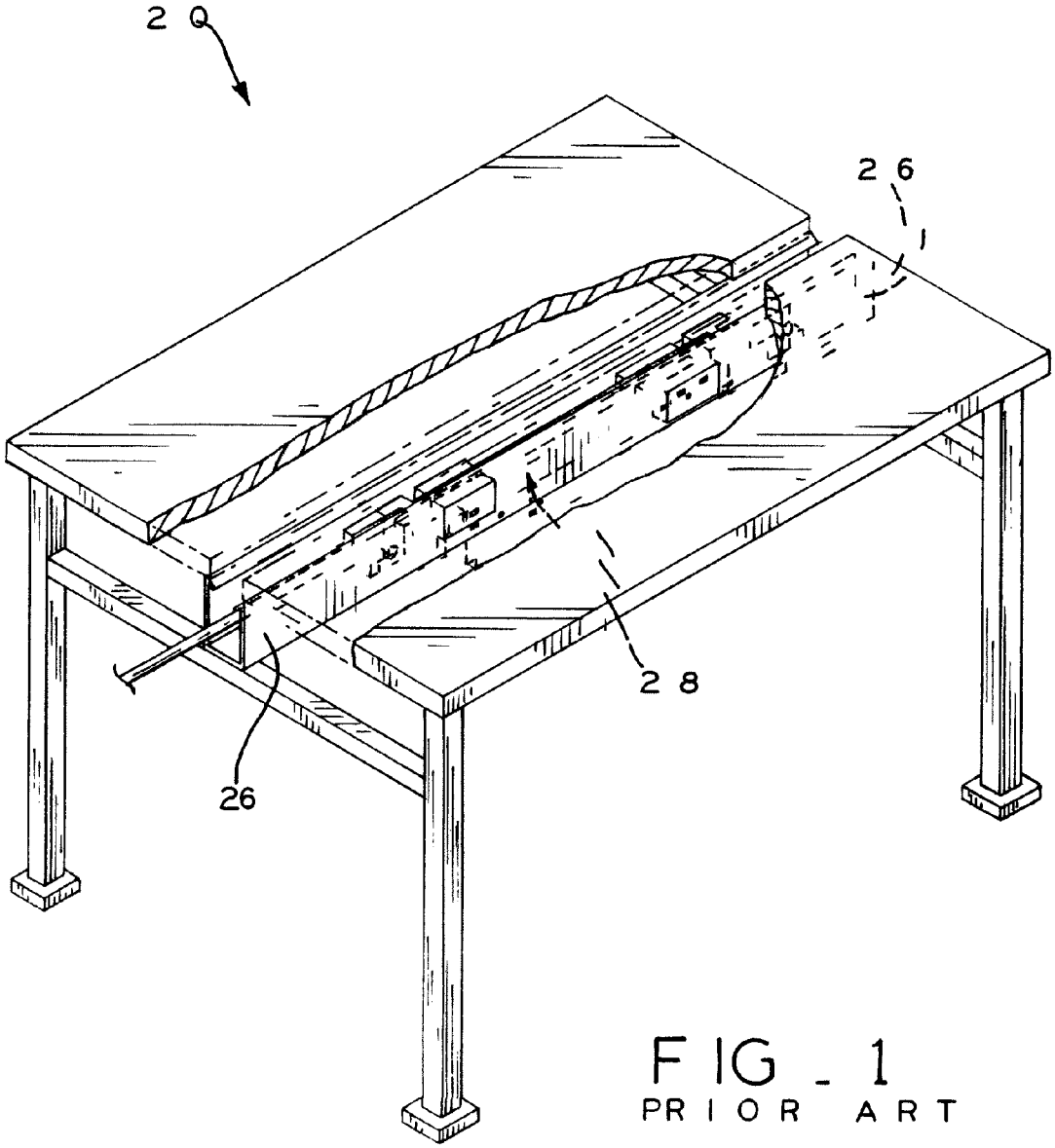
FIG. 1 PRIOR ART
FIG. 1 is an end view of a known table with a channel and a known electrical assembly.
Figure 2:
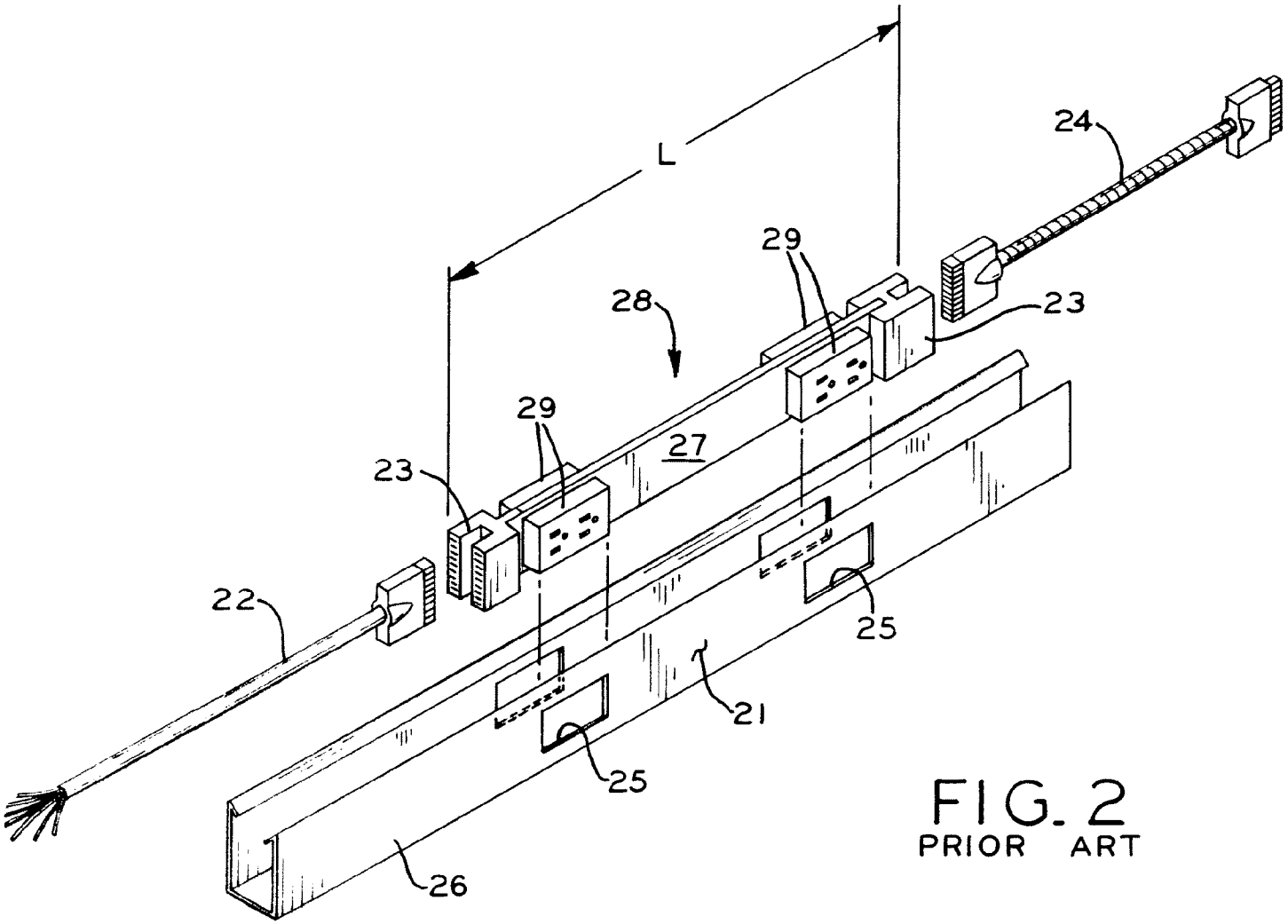
FIG. 2 PRIOR ART
FIG. 2 is an exploded view of the channel of the known table shown in FIG. 1, further illustrating the known electrical assembly.

Referring now to FIG. 14, an alternative wiring configuration is shown, which may utilize a known electrical harness 28, such as that described above. Power supply line 22 may enter trough 48 of channel 42 and connect to the electrical connector 23 of a known electrical harness 28. Buss bar 27 extends along trough 48 and provides electrical connector 23 at an opposite end of electrical harness 28. Instead of the fixed electrical outlets 29, as shown in FIG. 2, advantageously, electrical module assemblies 90 may be connected to electrical connectors 23 to provide flexibility with electrical outlet modules 52. For example, each electrical module assembly 90 connects to connectors 23 and may have module 52 associated therewith positioned in any cutout portion 50 proximate connector 23. Moreover, cable 92 of electrical module assembly 90 bridges the gap between buss bar 27 and sidewall 44 of channel 42 to provide easy access to electrical outlet module 52. Electrical jumper cable 24 may be attached to connector 23 at the opposite end of buss bar 27 with respect to power supply line 22 to provide a connection for another channel or article of furniture.

Figure 15:
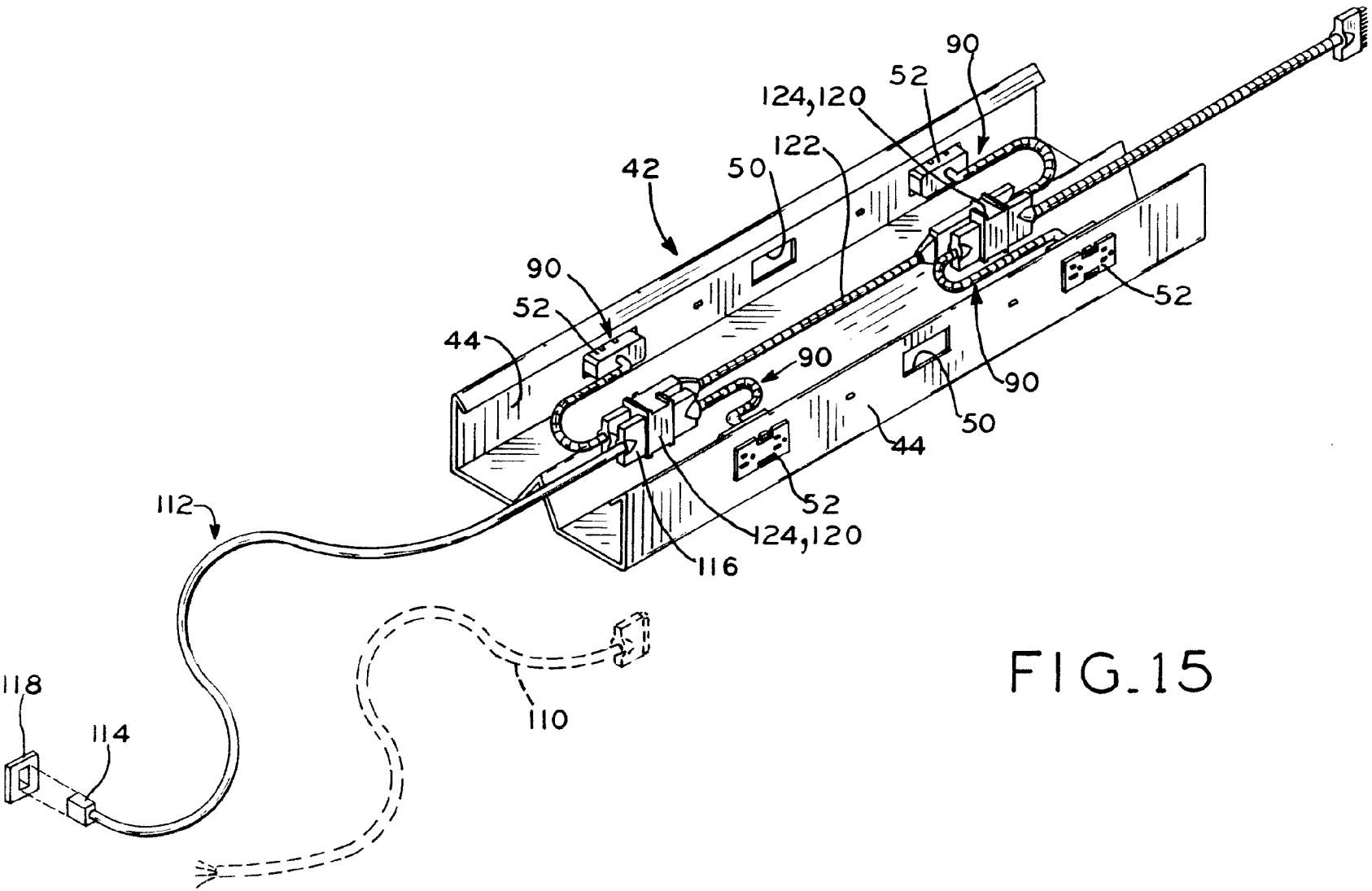
FIG. 15 is a perspective view of the channel of FIG. 3 with a wiring configuration according to a further embodiment.
Figure 16:
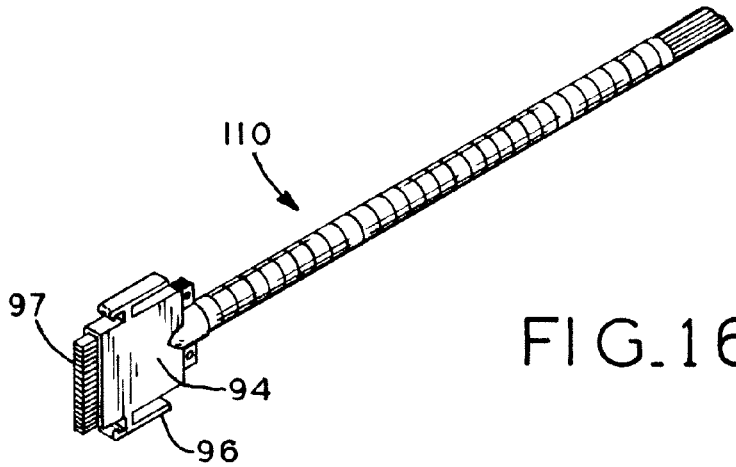
FIG. 16 is a perspective view of a power supply assembly.
Figure 17:
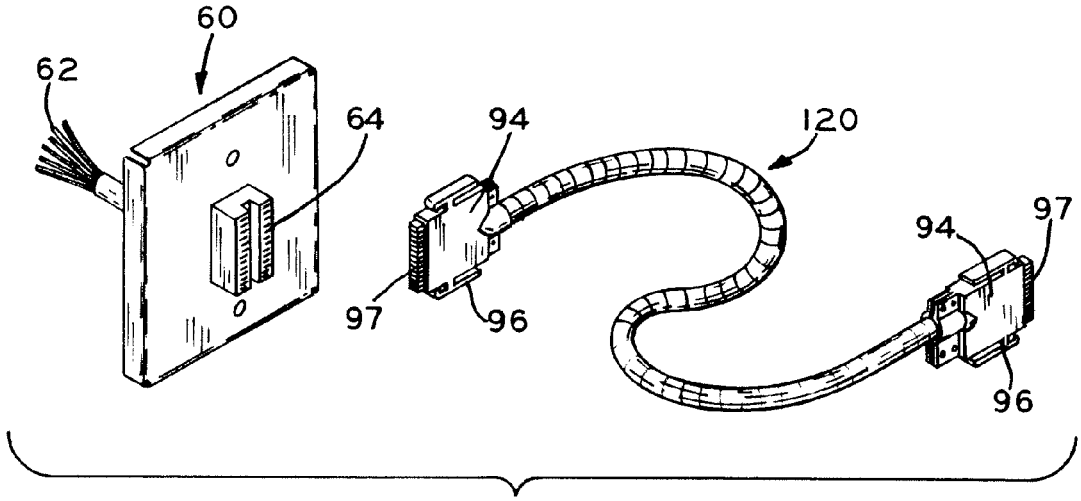
FIG. 17 is a perspective view of a modular wall assembly and a jumper assembly.

Referring to FIG. 15, channel 42 is shown including a wiring configuration according to a further embodiment, the wiring configuration including the components of FIGS. 16-18, as well as electrical module assemblies 90 which, except as discussed below, are substantially identical to those components described above, and the same reference numerals have been used to identify identical or substantially identical components therebetween. As shown in FIGS. 15-17, an electrical power supply assembly may include either a hard-wired assembly 110, shown in dashed lines, for a hard-wired connection to an existing electrical system in the wall of a building, or may include an electrical power supply assembly 112, shown in solid lines, including a conventional plug 114 and an electrical connector 116, with plug 114 receivable when within a conventional outlet 118 provided in the wall of a building, for example. Alternatively, power may be supplied to the system via a jumper assembly 120, shown in FIG. 17, which interfaces with a modular wall assembly such as that shown in FIG. 5 and is described above.

Figure 18:
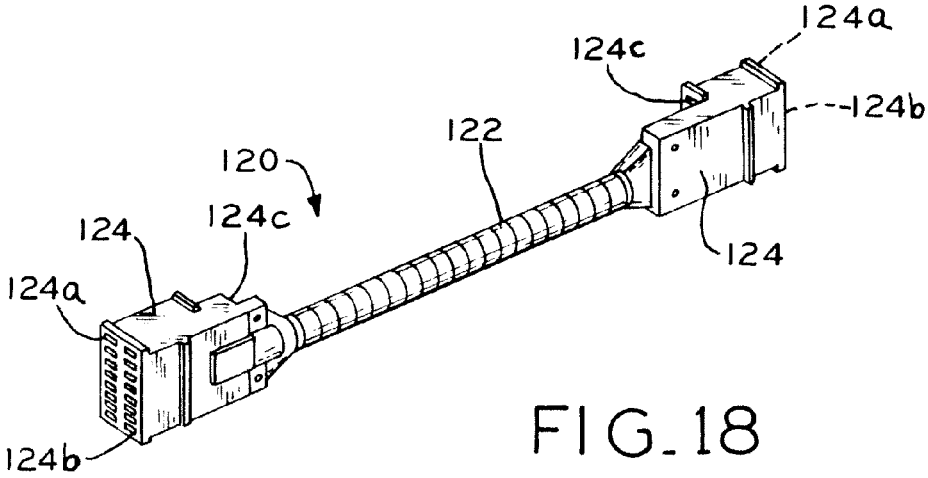
FIG. 18 is a perspective view of a connector assembly.

Referring to FIG. 18, electrical connector assembly 120 is shown which may include a jacketed, flexible cable 122 with electrical connector modules 124 at opposite ends thereof. Each electrical connector module 124 includes three electrical connectors 124*a*, 124*b*, and 124*c* for connecting to power supply assemblies, electrical outlet modules, or jumper assemblies, as described below.

Referring to FIG. 15, the electrical connector assembly 120 is shown disposed within channel 42, and connector module 124 at a first end thereof is connected to power supply assembly 110, 112 at one of its connector 124*a*, 124*b*, or 124*c*, with the remaining connectors 124*a*, 124*b*, or 124*c* respectively connected to a pair of electrical outlet module assemblies 90 including electrical modules 52 received within respective openings 50 in the side walls 44 of the channel 42. The opposite end of connector assembly 120 includes an additional connector module 124, with one of its connectors 124*a*, 124*b*, or 124*c* connected to a jumper assembly 126, and the remaining two of its connectors 124*a*, 124*b*, or 124*c* respectively connected to electrical outlet module assemblies 90 including electrical modules 52 received within respective openings 50 of side walls 44 of channel 42. Advantageously, the wiring configuration shown in FIG. 15 allows electrical outlet modules to be located within selective openings 50 along the side walls of channel 42 in any configuration that is desired by the user.

Figure 19:
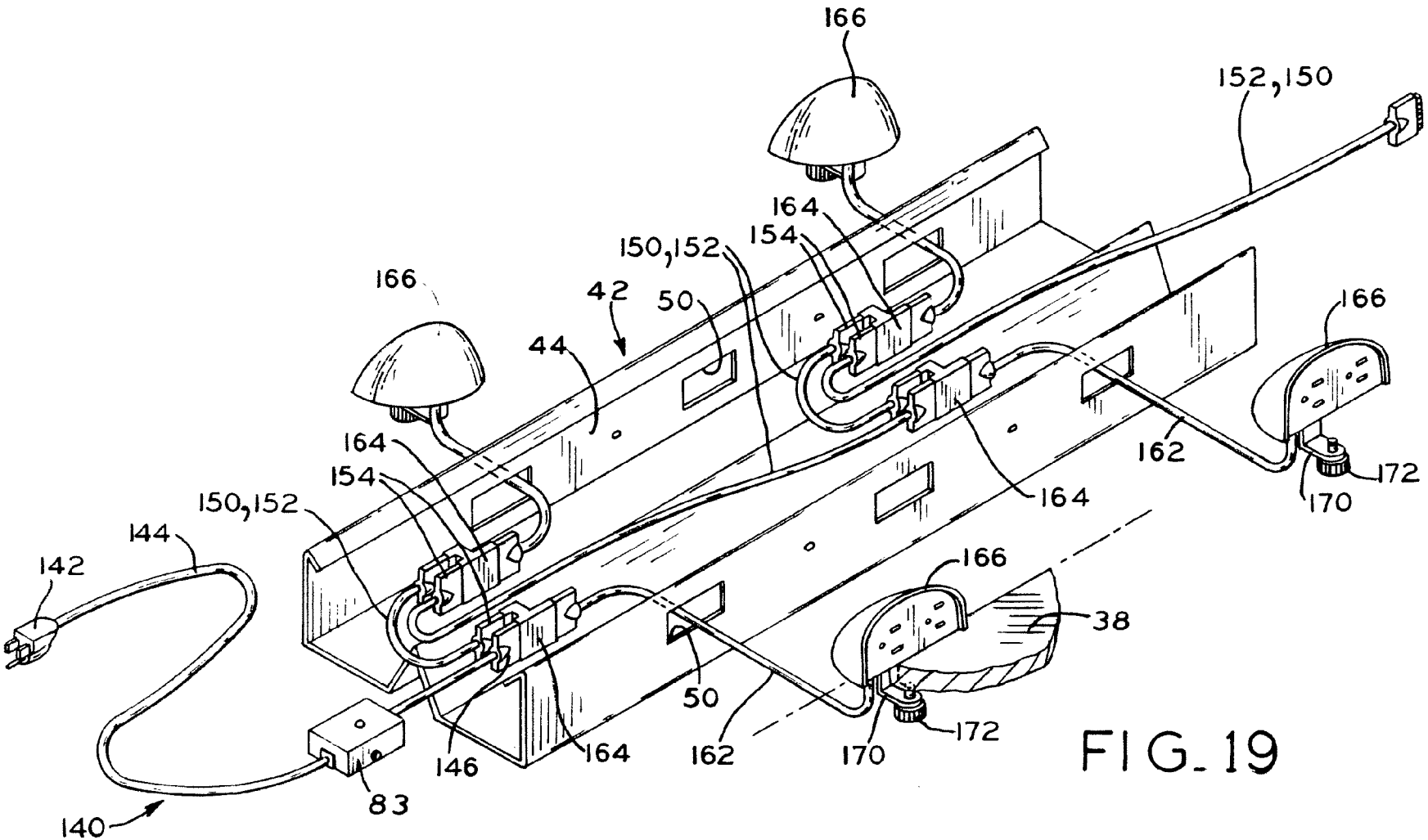
FIG. 19 is a perspective view of the channel of the desking system of FIG. 3, showing a wiring configuration according to a further embodiment.

Referring to FIG. 19, channel 42 of desking system 30 is shown with a wiring arrangement according to an additional embodiment, which generally includes electrical outlet module assemblies of the type shown in FIG. 21 which may be disposed outwardly of channel 42 and connected to work surfaces 38 as described below.

Figure 20:
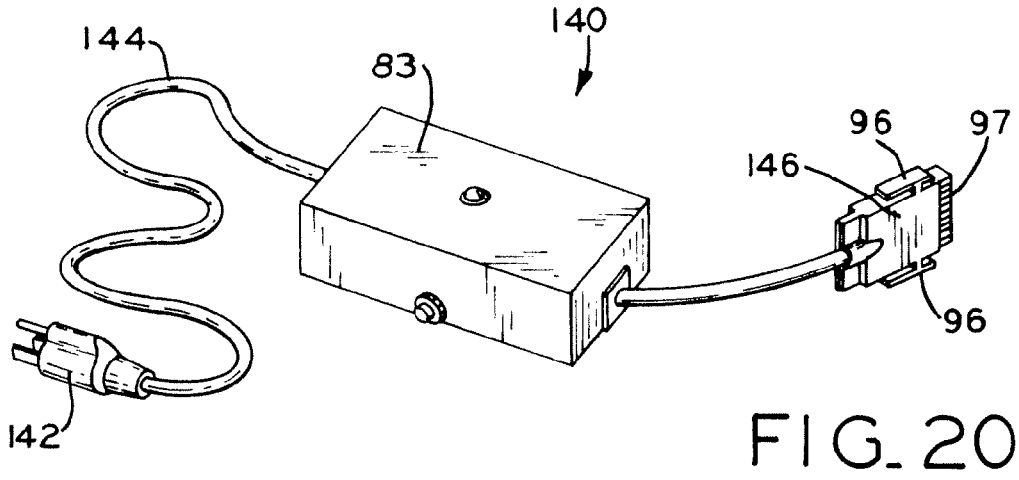
FIG. 20 is a perspective view of a power supply cable.

Referring to FIG. 20, a power supply cable assembly 140 is shown, which includes an electrical plug 142, cable 144, a single electrical connector 146, as well as circuit box 83, and is otherwise substantially identical to power supply cable assembly 80 shown in FIG. 8 and discussed above.

Figure 22:
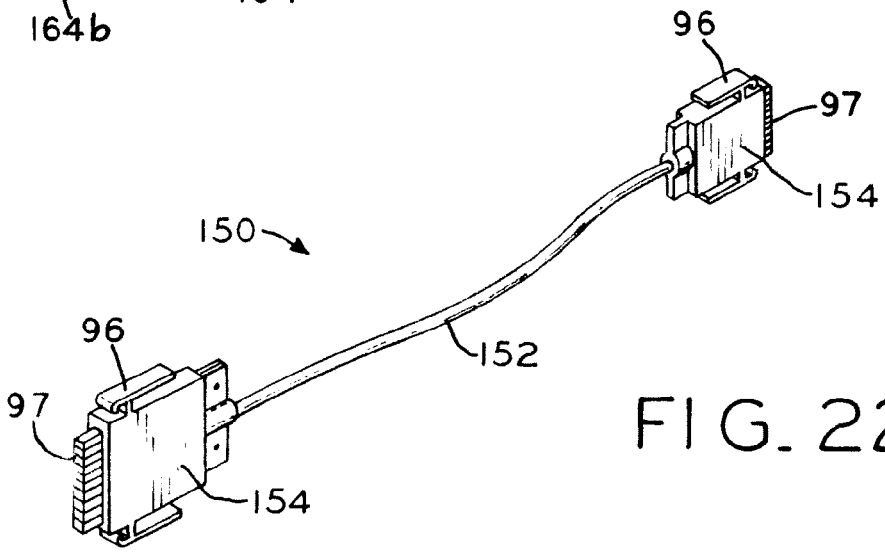
FIG. 22 is a perspective view of a jumper assembly.

Referring to FIG. 22, jumper assemblies 150 generally include a cable 152 having a pair of electrical connectors 154 at opposite ends thereof, respectively, and may be provided in various lengths.

Figure 21:
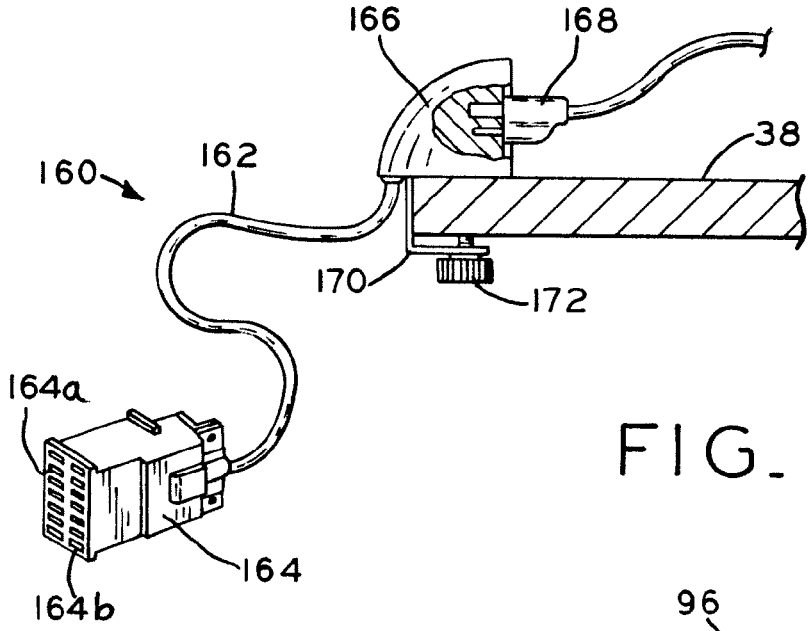
FIG. 21 is a partial sectional view through a work surface, showing an electrical outlet module and its mount structure, and further showing the plug of a peripheral device electrically connected to the electrical outlet module.

Referring to FIG. 21, each outlet module assembly 160 includes cable 162 having a connector module 164 with a pair of connectors 164*a* and 164*b* at first end thereof, and an electrical outlet module 166 at an opposite end thereof. Electrical outlet module 166 includes one or more conventional AC or DC electrical outlets to which the plug 168 of a peripheral device may be electrically connected, as shown in FIG. 21. Additionally, each electrical outlet module includes a work surface mounting structure including an L-shaped bracket 170 having a thumb screw 172 for securing electrical outlet module 166 to the edge of a work surface 38, as shown in FIG. 22.

In this manner, as shown in FIG. 19, electrical outlet modules 166 may be freely locatable along the edges of a work surface 38 at locations spaced generally vertically above channel 42, with the length of cables 162 of electrical outlet module assemblies 160 providing substantial freedom in the selection of desired locations of electrical outlet modules 166. In addition, as shown in FIG. 19, jumper assemblies 150 may be provided in various lengths to connect the foregoing components and to vary location of electrical outlet modules 166, and may pass through openings 50 in side walls 44 of channel 42 as shown. Additional jumper assemblies 150 may also be provided to provide electrical power to adjacent desk components within the desking system 30.

Figure 23:
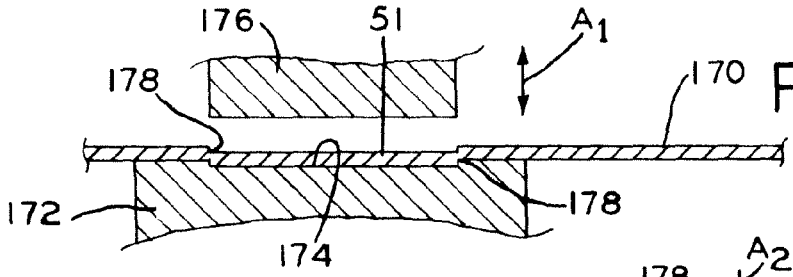
FIG. 23 is a schematic view showing the stamping of a knock-out portion in a metal sheet to form a periphery around the knock-out portion with the knock-out portion displaced at least partially outwardly from a plane defined by the sheet.
Figure 24B:
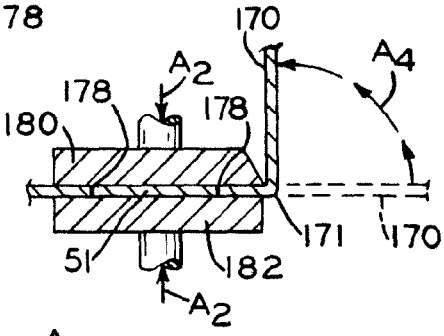
FIGS. 24A and 24B are a schematic view showing the bending the sheet of FIG. 23 along a bend line.
Figure 24A:
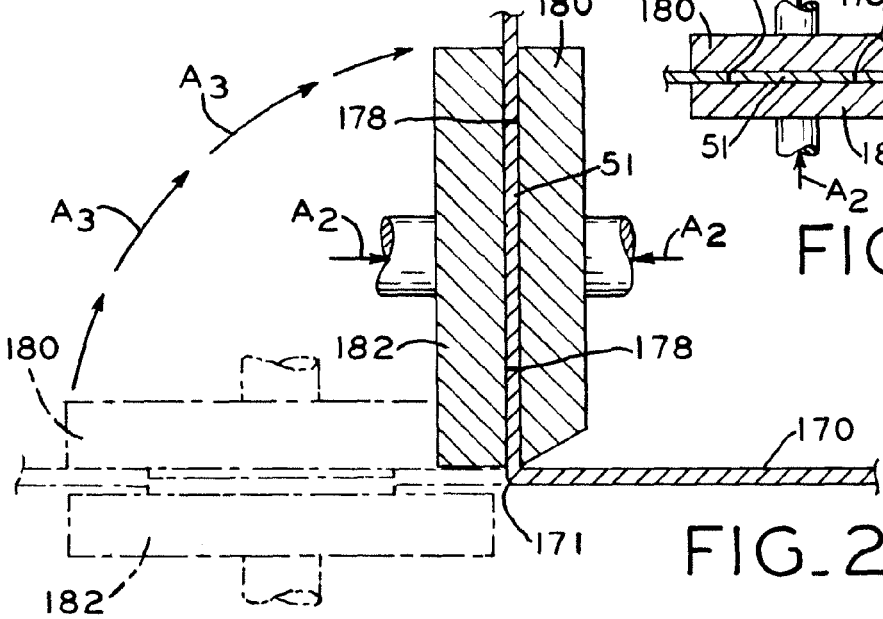
Figure 25:
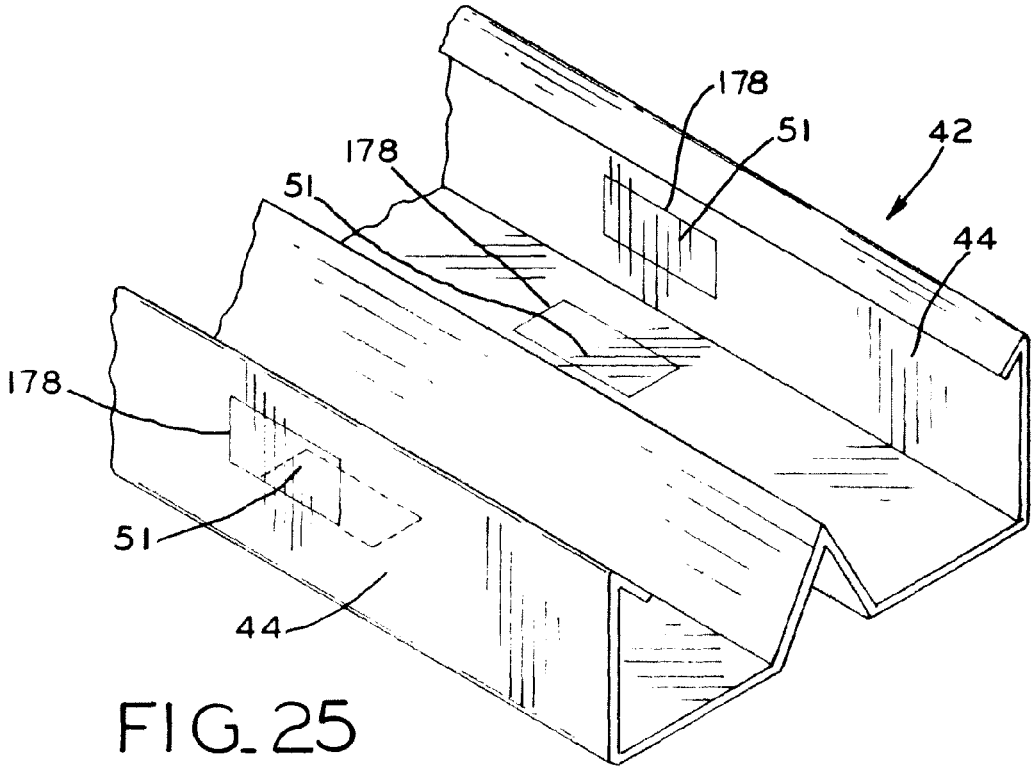
FIG. 25 is a perspective view of a channel formed by the bending process of FIG. 24, including a visually disguised knock-out portion.

Referring to FIGS. 23-25, an exemplary method for forming knock-out portions 51 within side walls 44 of channel 42 is shown. In this embodiment, knock-out portions 51 are formed in the context of the operation by which channel 42 itself is formed. Referring to FIG. 23, channel 42 is first provided as a flat sheet 170 of sheet metal, for example, which has been stamped to size from a larger sheet of sheet metal (not shown). Sheet 170 is placed over a first die 172 including one or more depressions 174 which each correspond to the periphery of a knock out portion 51, and one or more suitable punches 176 are used to stamp knock-out portions 51 in sheet 170 along the direction of arrow $A_1$ in FIG. 23, forming a periphery 178 which defines each knock-out portion 51. In this operation, each knock-out portion 51 is displaced at least partially outwardly from the plane defined by sheet 170.

Referring to FIGS. 24A and 24B, a subsequent bending operation is conducted using at least a pair of bending members 180 and 182. With sheet 170 suitably anchored by a clamping structure or other bending members (not shown), bending members 180 and 182 are forced against opposite sides of sheet 170 in the area of knock-out portion 51 along the directions or arrows $A_2$, and sheet 170 with knock-out portion 51 is clamped between bending members 180 and 182 as shown in dashed lines in FIG. 24A and in solid lines in FIG. 24B, thereby forcing knock-out portion 51 substantially back within the plane defined by sheet 170 while preserving the periphery 178 around each knock-out portion 51. As shown in FIG. 24A, in one embodiment, bending members 180 and 182 are displaced in the direction of arrows $A_3$ from the initial clamped position described above, shown in dashed lines in FIG. 24A, to a bent position, shown in solid lines in FIG. 24A, in which a portion of sheet 170 is bent along a bend line 171 disposed substantially adjacent knock-out portion. Alternatively, in an opposite manner according to the embodiment shown in FIG. 24B, bending members 180 and 182 may remain stationary while the adjacent section of sheet 170 is bent around the bend line 171 along the direction of arrow $A_4$.

Referring to FIG. 25, further bending and forming operations may be conducted to form the final shape of channel 42. Advantageously, as may be seen in FIG. 25, because knock-out portions 51 have been depressed substantially back within the plane defined by sheet 170, which corresponds to side walls 44 of channel 42, the periphery 178 of each knock-out portion 51 is preserved as a weakened portion or enervation, such that each knock-out portion 51 may be optionally removed to define an opening 50 in channel 42, yet the periphery 178 of each knock-out portion 51 is disguised such that knock-out portions 51 are not easily visible within side walls 44 of channel 42, providing a more aesthetic appearance.

While this invention has been described as having exemplary embodiments and scenarios, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An article of furniture, comprising:

at least a pair of leg assemblies;

a horizontally-disposed beam connecting said leg assemblies;

a horizontally-disposed, relatively wide channel mounted to said beam, said channel including first and second opposing side walls having a central space therebetween, said first side wall having at least one first opening, said second side wall having at least one second opening;

a plurality of work surface supports connected to said leg assemblies, said work surface supports supporting at least a pair of work surfaces above said leg assemblies at locations disposed vertically upwardly from said channel; and an electrical system disposed within said channel, said electrical system comprising:

a power supply assembly including at least one first connector at one end thereof, said power supply assembly connected to a source of electrical power at an opposite end thereof;

an electrical connector assembly including a plurality of second connectors, including at least one second connector at one end of said connector assembly and at least one second connector at an opposite end of said connector assembly, one of said second connectors connected to said first connector;

at least one first electrical outlet module assembly having a first outlet module with an electrical outlet, a third connector, and a flexible cable defining first and second ends, said flexible cable directly attached to said first outlet module at said first end, said flexible cable directly attached to said third connector at said second end, said third connector spaced from said first outlet module, said third connector connected to at least one of said first and second connectors, and said first outlet module mounted within a said first opening of said first wall with said electrical outlet accessible from externally of said channel;

at least one second electrical outlet module assembly having an a second outlet module with an electrical outlet, a third connector, and a flexible cable defining first and second ends, said flexible cable directly attached to said second outlet module at said first end, said flexible cable directly attached to said third connector at said second end, said third connector spaced from said second outlet module, said third connector connected to at least one of said first and second connectors, and said second outlet module mounted within a said second opening of said second wall with said electrical outlet accessible from externally of said channel; and said first, second, and third connectors disposed within said central space of said channel and positioned substantially horizontally in between, and spaced from, said first and second outlet modules.

2. The article of furniture of claim 1, wherein said first and second outlet modules each includes at least one flexible tab, said flexible tabs engageable with said channel at said first and second openings, respectively, to connect said first and second outlet modules within said first and second openings.

3. The article of furniture of claim 1, wherein said flexible cable of at least one of said first and second electrical outlet module assemblies spans a distance within said channel between said second connector of said respective first and second connector assembly and said electrical outlet connected to one of said first and second openings.

4. The article of furniture of claim 1, wherein said side walls of said channel each have a plurality of openings, and said electrical system includes a plurality of said electrical outlet module assemblies including a plurality of outlet modules, each outlet module having an electrical outlet, said outlet modules of said electrical outlet module assemblies connected to respective ones of said openings on each of said opposite side walls with said electrical outlets accessible from each of said opposite side walls.

5. The article of furniture of claim 4, wherein said outlet modules of said opposite sides are disposed in staggered locations with respect to one another along a length of said channel.

6. The article of furniture of claim 1, wherein a gap is present between horizontal rear edges of a pair of said work surfaces, said electrical outlet accessible from above said work surfaces through said gap.

7. The article of furniture of claim 1, wherein said work surface supports are adjustably connected to said leg assemblies for adjusting a height of said work surfaces with respect to said channel.

8. The article of furniture of claim 1, wherein said first and second openings are formed as knock-out openings each including a removable knock-out portion.

9. The article of furniture of claim 8, wherein said knock-out portions are disposed substantially within a plane defined by a surface of said channel in which said knock-out openings are formed.

10. The article of furniture of claim 1, wherein at least one end of said connector assembly includes three connectors for reception of up to three electrical outlet modules.

11. The article of furniture of claim 1, wherein said first and second outlet modules each further comprise a rear surface, said flexible cable of each of said first and second electrical outlet module assemblies directly attached to said rear surface of each of said first and second outlet modules, respectively, at said first end of said flexible cable.

12. An article of furniture, comprising:

at least a pair of leg assemblies;

a horizontally-disposed beam connecting said leg assemblies;

a horizontally-disposed channel mounted to said beam, said channel including a pair of side walls with at least one of said side walls having a plurality of openings;

a plurality of work surface supports connected to said leg assemblies, said work surface supports supporting at least a pair of work surfaces above said leg assemblies at locations disposed vertically upwardly from said channel; and an electrical system disposed within said channel, said electrical system comprising:

a power supply assembly including at least one first connector at one end thereof, said power supply assembly connected to a source of electrical power at an opposite end thereof;

an electrical connector assembly including a plurality of second connectors, including at least one second connector at one end of said connector assembly and at least one second connector at an opposite end of said connector assembly, one of said second connectors connected to said first connector; and at least a first and a second electrical outlet module assembly, each having an outlet module with an electrical outlet, a third connector, and a flexible cable defining first and second ends, said flexible cable directly attached to said outlet module at said first end, said flexible cable directly attached to said third connector at said second end, said third connector spaced from said outlet module, said third connector connected to at least one of said first and second connectors, said outlet module disposed externally of said channel, said third connector disposed within said channel, and said flexible cable passing through said one of said channel openings, said outlet module further including a mount structure connecting said outlet module to an edge of one of said work surfaces.

13. The article of furniture of claim 12, wherein said outlet module further comprises a rear surface, said flexible cable directly attached to said rear surface of said outlet module at said first end.

* * * * *